US006193354B1

(12) United States Patent
Ito

(10) Patent No.: US 6,193,354 B1
(45) Date of Patent: Feb. 27, 2001

(54) INK JET RECORDER

(75) Inventor: Masaharu Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/058,863

(22) Filed: Apr. 13, 1998

(30) Foreign Application Priority Data

Apr. 14, 1997 (JP) ..... 9-096092

(51) Int. Cl.[7] ..... B41J 2/165
(52) U.S. Cl. ..... 347/30
(58) Field of Search ..... 347/30, 23, 85, 347/7, 36, 33

(56) References Cited

U.S. PATENT DOCUMENTS

| | | | | |
|---|---|---|---|---|
| 4,359,744 | * | 11/1982 | Salmre | 347/30 |
| 4,367,479 | | 1/1983 | Bower | 347/33 |
| 4,558,326 | * | 12/1985 | Kimura | 347/30 |
| 4,590,494 | | 5/1986 | Ichihashi et al. | 347/43 |
| 4,947,191 | * | 8/1990 | Nozawa et al. | 347/30 |
| 5,248,999 | * | 9/1993 | Mochizuki et al. | 347/23 |
| 5,426,456 | * | 6/1995 | Kuelzer et al. | 347/30 |
| 5,450,105 | | 9/1995 | Dangelo | 347/30 |
| 5,486,854 | | 1/1996 | Uchida | 347/30 |
| 5,570,116 | | 10/1996 | Soga | 347/30 |

FOREIGN PATENT DOCUMENTS

| | | | | |
|---|---|---|---|---|
| 56-167463 | * | 12/1981 | (JP) | 347/85 |
| 60-040258 | * | 3/1985 | (JP) | 347/30 |
| 03278962 | * | 10/1991 | (JP) | 347/85 |
| 3-277555 | | 12/1991 | (JP) . | |
| 3-278962 | | 12/1991 | (JP) . | |

* cited by examiner

*Primary Examiner*—David F. Yockey
*Assistant Examiner*—Charles W. Stewart, Jr.
(74) *Attorney, Agent, or Firm*—Oliff & Berridge, PLC

(57) ABSTRACT

An ink jet recorder includes an ink jet head having a nozzle, which can be capped with a cap and a suction pump for purging the nozzle through the cap. The recorder further includes a pressure control unit interposed between an ink supply and the head to control the pressure on the ink in the nozzle. At least just before purging finishes, the control unit applies positive pressure to the ink in the nozzle to prevent the air bubbles, the foreign substances and/or the like sucked into the cap by the pump from flowing back into the head. The control unit may include an ink tank and a height adjuster for adjusting the height of the tank relative to the front end of the nozzle.

19 Claims, 7 Drawing Sheets

INK JET RECORDER

BACKGROUND OF THE INVENTION

1. Field of the Invention

The present invention relates to an ink jet printer or recorder for forming an image by ejecting ink from its ink jet head. Specifically, the invention relates to an ink jet printer which makes it possible to suck and remove bad or defective ink, foreign substances, air bubbles, and/or the like from the ink jet head with the head nozzle capped.

2. Description of Related Art

A conventional ink jet printer of this type includes an ink jet head, which has a nozzle for ejecting ink and ink chambers storing ink behind the nozzle. By generating pressure vibration in one or more the ink chambers, it is possible to eject ink from the nozzle to form an image on a recording medium.

The printer also includes a cap for covering the outer side of the nozzle airtightly. The printer further includes a suction device, which may be a suction pump, for developing negative pressure in the cap in airtight contact with the nozzle to suck ink from the nozzle. The negative pressure developed in the cap covering the nozzle can suck and remove bad ink, foreign substances, air bubbles and/or the like from the nozzle. It is therefore possible to prevent defective ejection of ink from the nozzle so that a clear image can be formed.

On the other hand, negative pressure is applied always to the ink chambers and the nozzle. This negative pressure prevents ink from leaking from the nozzle, and allows ink to be ejected only when pressure vibration develops in one or more of the chambers. This prevents recording media from staining or spotting. The negative pressure may, however, worsen the suction and removal with the pump for the reason stated below.

FIGS. 5A–5D of the accompanying drawings show the suction and removal process as part of the maintenance of a conventional ink jet printer. The printer includes an ink jet head 73, which includes a nozzle plate 75 having a nozzle 75*a* for ejecting ink. The head 73 has ink chambers 77*a* storing ink behind the nozzle plate 75. The chambers 77*a* are connected to the nozzle 75*a*. The head 73 also includes actuators 77 including piezoelectric elements. Each of the actuators 77 is associated with one of the chambers 77*a*. The head 73 further includes a manifold 79 connected to the chambers 77*a*. The manifold 79 is also connected through a tube (not shown) or the like to an ink tank (not shown) for supplying the chambers 77*a* with ink. When one or more of the actuators 77 are energized to generate pressure vibrations in the associated chambers 77*a*, ink is ejected from the nozzle 75*a*.

This printer also includes a cap 83 for compressively contacting the nozzle surface 75*b* of the nozzle plate 75 to airtightly cover the outer side of the nozzle 75*a*. The cap 83 has a suction port 83*a* connected to a suction pump (not shown). When the pump is driven, negative pressure develops in the cap 83.

As shown in FIG. 5A, air bubbles 99 may be produced in the ink chambers 77*a*. As shown in FIG. 5B, it is possible to suck and remove the bubbles 99 together with ink by capping the nozzle 75*a* with the cap 83 and driving the pump.

On the other hand, negative pressure is applied always to the ink chambers 77*a* and nozzle 75*a*. Immediately after the pump stops, as shown in FIG. 5C, this negative pressure may draw back into the ink jet head 73 some of the bubbles 99 sucked already into the cap 83. Even after the suction ends and the cap 83 separates from the head 73, as shown in FIG. 5D, air bubbles 99 remain in the head, and may cause defective ejection of ink from the nozzle 75*a*. Not only the bubbles 99 but also foreign substances and/or solidified ink may be drawn back into the head 73, and cause defective ejection of ink.

SUMMARY OF THE INVENTION

It is an object of the invention to provide an ink jet recorder in which air bubbles etc. can be removed securely from the ink jet head with the nozzle capped airtightly, to prevent the head from ejecting ink defectively.

In accordance with the invention, an ink jet recorder is provided, which includes an ink jet head having a nozzle for ejecting ink. The head also has ink passages formed in it and communicating with the nozzle. The nozzle can be capped with a suction cap. The recorder also includes a suction pump for sucking ink from the nozzle through the cap to purge the nozzle. The recorder further includes an ink supply for supplying the head with ink. A pressure control unit is provided or interposed between the supply and the head to control the pressure applied to the ink in the nozzle.

The pressure control unit applies positive pressure to the ink in the nozzle at least just before purging finishes, that is to say, before the suction cap is separated from the ink jet head. This prevents the air bubbles, the foreign substances and/or the like sucked already into the cap by the suction pump from flowing back into the head. Consequently, the ink jet recorder can prevent defective ejection of ink, particularly just after the purging.

When the suction cap is separated from the ink jet head during the purging, the suction pump may be either stopped or kept driven to suck the ink remaining in the cap (sucking ink and air to keep the head clean).

While the nozzle is not capped, the pressure control unit may apply negative pressure to the ink in the nozzle to maintain the menisci of ink in the nozzle.

The pressure control unit may include an ink tank in liquid communication with the ink passages in the ink jet head. The unit may also include a tank height adjuster for adjusting the height of the tank relatively to the front end of the nozzle. By using the tank and the height adjuster, it is possible to simplify the structure of the control unit and make the pressure control easy. The height adjuster can make the ink surface in the tank higher than that in the nozzle to produce a head difference for applying positive pressure to the ink in the nozzle so that the ink can be discharged from the nozzle. The adjuster can also make the ink surface in the tank lower than that in the nozzle to apply negative pressure to the ink in the nozzle so that the menisci of ink can be maintained well in the nozzle.

The pressure control unit may instead be a pump provided between the ink supply and the ink jet head.

The ink jet recorder may also include a controller for controlling the driving of the tank height adjuster and the suction pump. The controller may be a microcomputer for batch control of the operation of the recorder.

The ink jet recorder may further include a detector for detecting the ink level in the ink tank. On the basis of the result of the detection by the detector, the controller may control the tank height adjuster in such a manner that the ink surface in the ink tank is positioned at a predetermined level relative to the front end of the nozzle.

The ink supply may be an ink cartridge, which can be replaced by the user. The cartridge may contain ink and be sealed. The cartridge may be larger in volume than the ink tank. The ink tank may be open so that the ink in it may be exposed to the atmosphere. In this case, it is preferable that the tank be as small as possible in volume to prevent the ink from oxidizing or altering otherwise in quality. If the tank is small, however, the ink jet recorder can record only a small number of images continuously. By making the cartridge (main ink tank) larger than the tank, it is possible to replenish ink all times from the cartridge and therefore perform continuous recording even if the tank is small. Because the cartridge is closed, the ink in it is inhibited from altering in quality.

The side walls of the ink passages may be made of piezoelectric material. The invention can be also applied to bubble jet type ink jet recorders.

BRIEF DESCRIPTION OF THE DRAWINGS

A preferred embodiment of the invention is shown in the accompanying drawings, in which.

DETAILED DESCRIPTION OF PREFERRED EMBODIMENTS

Figure 1:
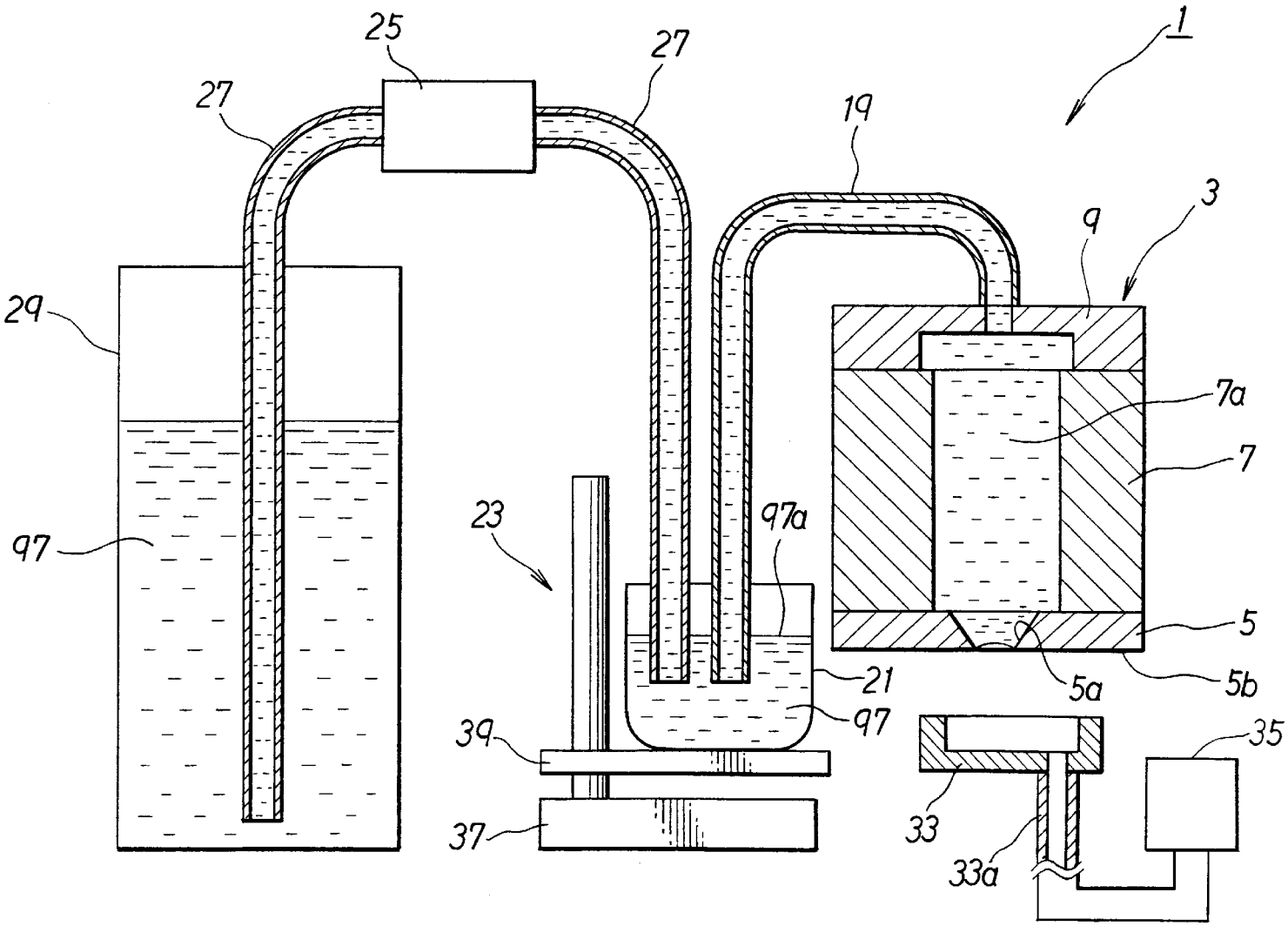
FIG. 1 is a schematic view in vertical section of an ink jet printer according to the embodiment.
Figure 3:
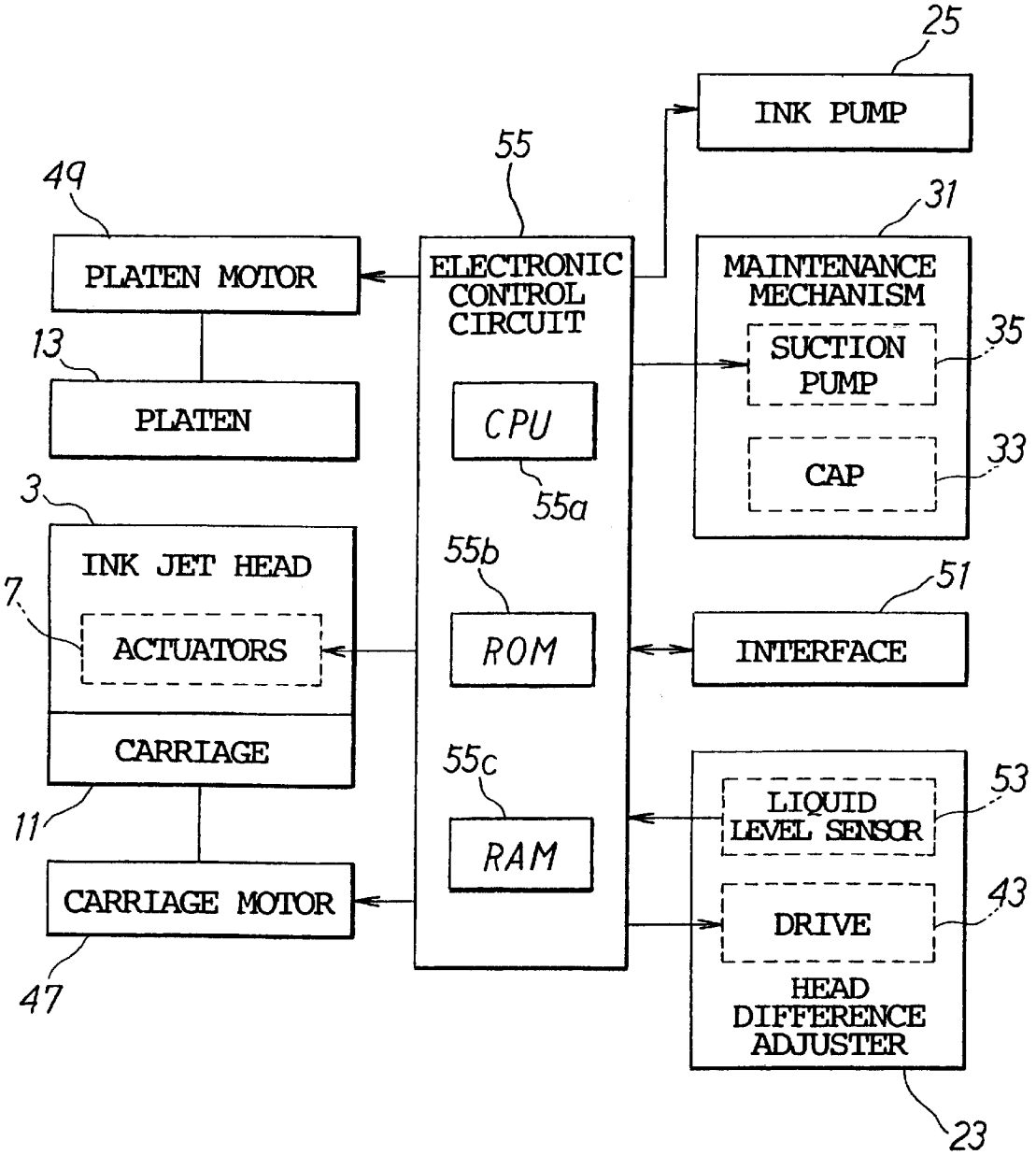
FIG. 3 is a block diagram of the control system of the printer.

With reference to FIG. 1, an ink jet printer 1 according to the invention includes an ink jet head 3 mounted on a known carriage 11 (FIG. 3), which can move along a known cylindrical platen 13 (FIG. 3). The head 3 includes a nozzle plate 5 at its bottom, which has a nozzle 5*a* for ejecting ink. The head 3 has ink chambers 7*a* storing ink and positioned over the nozzle plate 5. The head 3 also includes actuators 7 including piezoelectric elements. The actuators 7 are each associated with one of the chambers 7*a*. The head 3 further includes a manifold 9 at its top, which is connected to the chambers 7*a*. The manifold 9 is also connected through a tube 19 to an open ink tank 21 for supplying the head 3 with ink 97. When one or more of the actuators 7 are energized to generate pressure vibrations in the associated chambers 7*a*, ink is ejected from the nozzle 5*a*.

The surface 97*a* of the ink 97 stored in the tank 21 is exposed to the atmospheric pressure. The tank 21 is supported vertically movably by a head difference adjuster 23. The tank 21 is connected through a tube 27 to a closed main tank 29. The tube 27 is fitted with an ink pump 25 in its middle for supplying ink from the closed tank 29 to the open tank 21. The closed tank 29 contains more ink than the open tank 21.

The printer 1 further includes a maintenance mechanism 31 (FIG. 3) for cleaning the ink jet head 3 in a predetermined maintenance position. This mechanism 31 includes a cap 33 which can be moved into compressive contact with the nozzle surface 5*b* of the nozzle plate 5 by a moving device (not shown) to cover the outer side of the nozzle 5*a* airtightly. The cap 33 has a suction port 33*a* connected to a suction pump 35 (FIG. 3). By capping the nozzle 5*a* with the cap 33 and driving the pump 35, thereby developing negative pressure in the cap 33, it is possible to suck and remove bad ink and/or the like out of the head 3. The maintenance mechanism 31 also includes a known wiper (not shown) etc.

U.S. Pat. Nos. 5,450,105, 5,486,854 and 5,570,116 disclose maintenance mechanisms each including a suction pump which can be used in the printer 1. The disclosure of the patents is incorporated herein by reference.

Figure 2A:
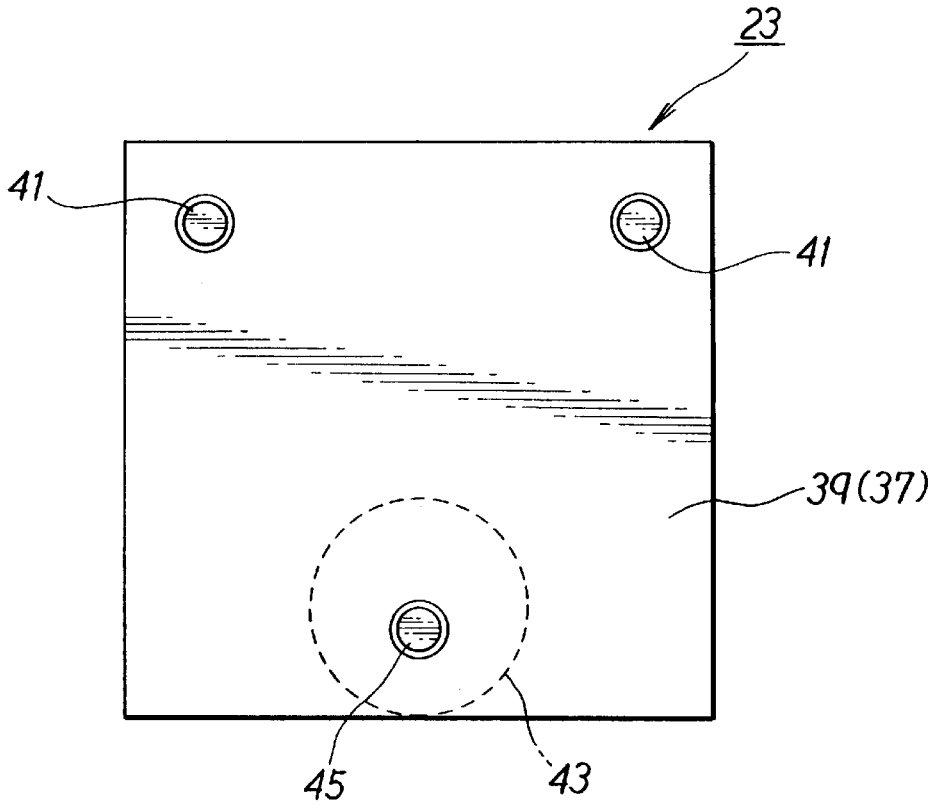
FIGS. 2A and 2B are a top plan and a front view, respectively, of the head difference adjuster of the printer.
Figure 2B:
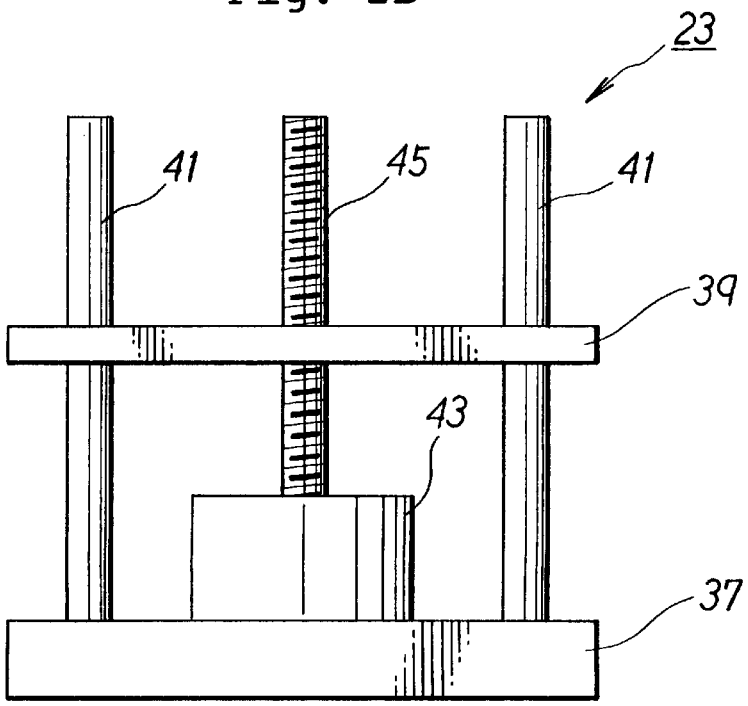

As shown in FIGS. 2A and 2B, the head difference adjuster 23 includes a square sill or base plate 37 and a square horizontal movable table or plate 39. A pair of vertical cylindrical guides 41 stand on the sill 37 near its two adjacent vertexes or corners. The guides 41 extend loosely through the table 39. A drive unit 43 is mounted on the sill 37 midway between the other corners. The drive 43 may include an AC motor, a DC motor, a stepping motor or another rotating actuator. A vertical ball screw 45 extends from the drive 43 and can be rotated by it. The table 39 is in engagement with the screw 45 and kept horizontal. When the screw 45 rotates, the table 39 moves vertically.

As shown in FIG. 3, the printer 1 further includes a carriage motor 47 for moving the carriage 11 through a belt etc., a platen motor 49 for turning the platen 13 to feed a recording sheet (not shown) as a recording medium, an interface 51 for sending signals to and receiving signals from an external computer, and a liquid level sensor 53 for detecting the level of the ink surface 97*a* relative to the adjuster sill 37. The sensor 53 may detect the ink level on the basis of the electric conduction between terminals, because ink is conductive. These components 47, 49, 51 and 53 are connected to an electronic control circuit 55, which is connected to the actuators 7, the pumps 25 and 35, and the drive 43.

The control 55 is a microcomputer including a CPU 55*a*, a ROM 55*b* and a RAM 55*c*. On the basis of the signals input from the interface 51 and the liquid level sensor 53, the control 55 controls the driving of the actuators 7, the pumps 25 and 35, the drive 43 and the motors 47 and 49 as follows.

If image data are input, the control 55 performs a process of image formation, which includes driving the platen motor 49 to feed a recording sheet, driving the carriage motor 47 to move the ink jet head 3 to a desired position, and subsequently energizing one or more of the actuators 7 to eject ink from the nozzle 5*a*. This process is repeated to form an image on the sheet in accordance with the data.

During the process of image formation, the control 55 energizes the drive 43 on the basis of the signal from the liquid level sensor 53 to position the ink surface 97*a* at a predetermined distance below the nozzle 5*a*. The nozzle 5*a* is kept at a constant height relative to the adjuster sill 37 by the carriage 11 for holding the ink jet head 3 thereon. Because the ink chambers 7*a*, the tube 19 and the open ink tank 21 are filled with ink, the head difference h1 (FIG. 4A) between the surface 97*a* and the nozzle 5*a* applies negative pressure to the ink in the nozzle. Concave menisci of ink are formed in the holes of the nozzle 5*a*, and their surface tension balances with the negative pressure. This keeps ink from leaking out of the nozzle 5*a* while the actuators 5 are not energized. It is therefore possible to eject ink only to desired spots, well preventing recording sheets from being stained.

The control 55 can detect a decrease in the ink in the open tank 21 on the basis of the amount of driving of the drive 43 and the signal from the liquid level sensor 53. During the process of image formation, if the control 55 detects an ink decrease in the open tank 21, it drives the ink pump 25 to supply this tank 21 from the main tank 29.

The control 55 performs a maintenance process at a predetermined time during the process of image formation, a predetermined time after the printer 1 is switched on, or another predetermine time. The maintenance process is shown in FIGS. 4A–4D.

Figure 4A:
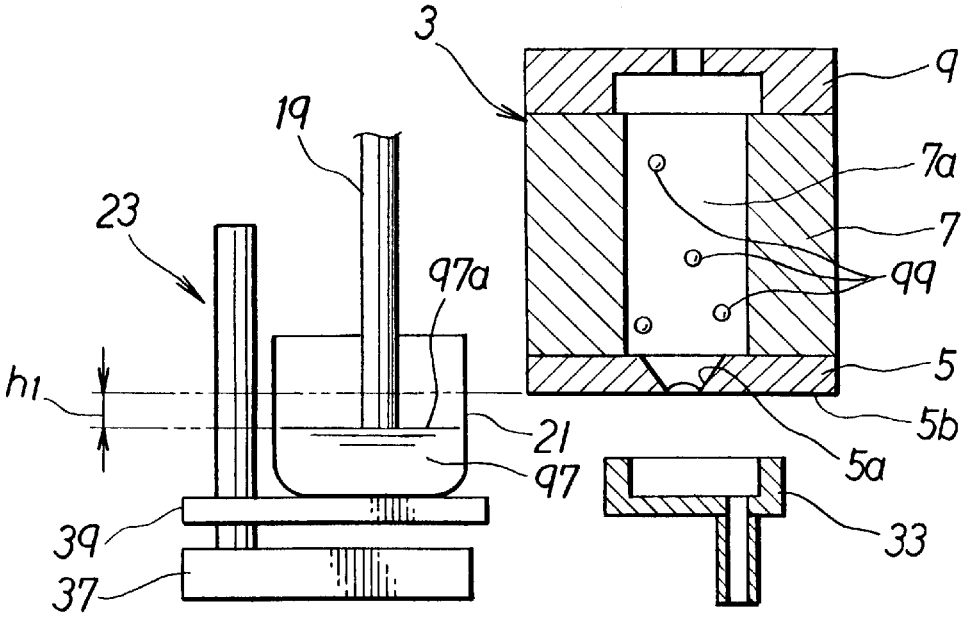
FIGS. 4A–4D are views similar to FIG. 1, but showing the suction and removal process of the printer.

At one the predetermined times, the control 55 energizes the carriage motor 47 to move the ink jet head 3 to the maintenance position, as shown in FIG. 4A, where the nozzle 5*a* faces the cap 33. At this stage or point, the ink surface 97*a* is positioned below the nozzle surface 5*b*.

Figure 4B:
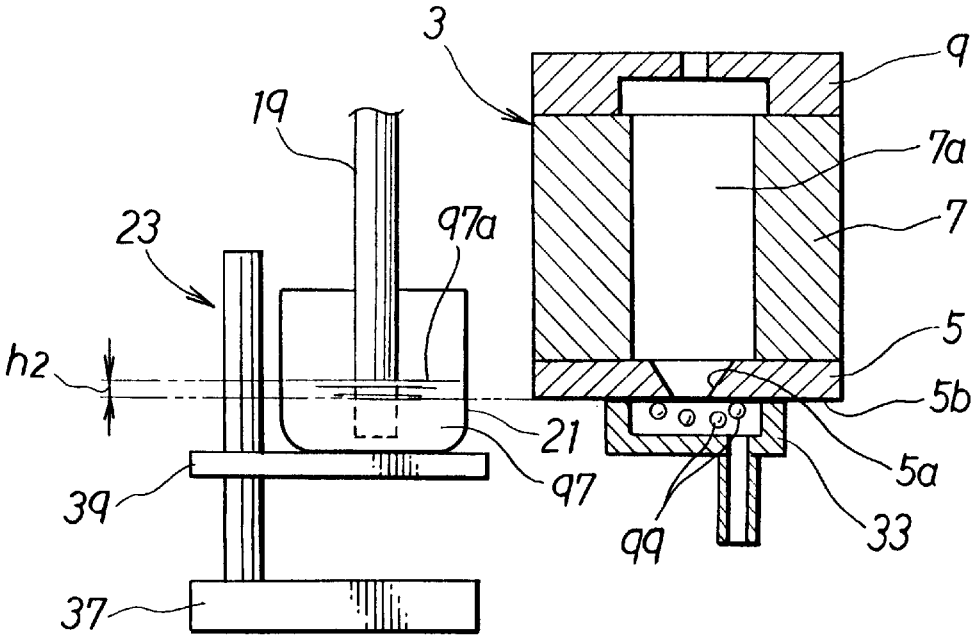
Figure 4C:
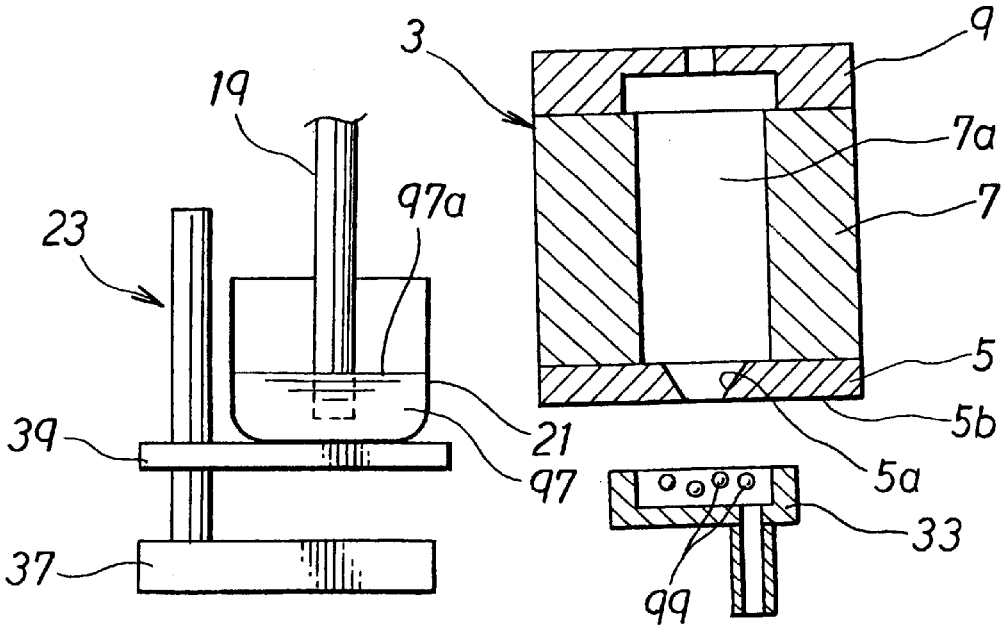
Figure 4D:
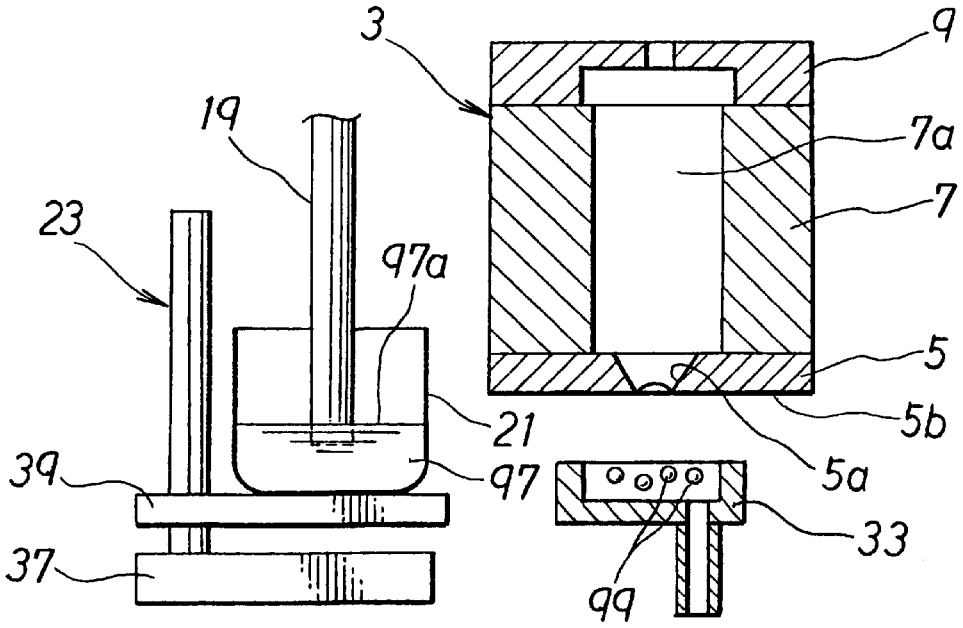
Figure 5A:
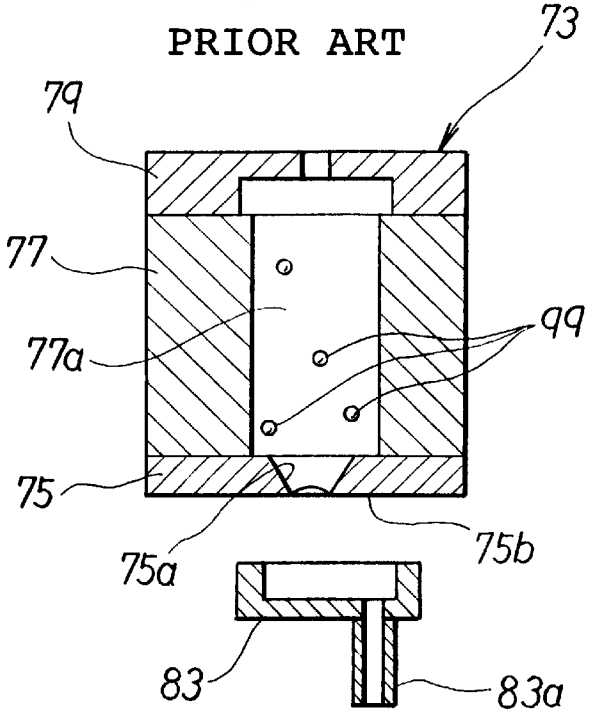
Fig. 5A PRIOR ART
FIGS. 5A–5D are schematic views showing the suction and removal process of a conventional ink jet printer.
Figure 5B:
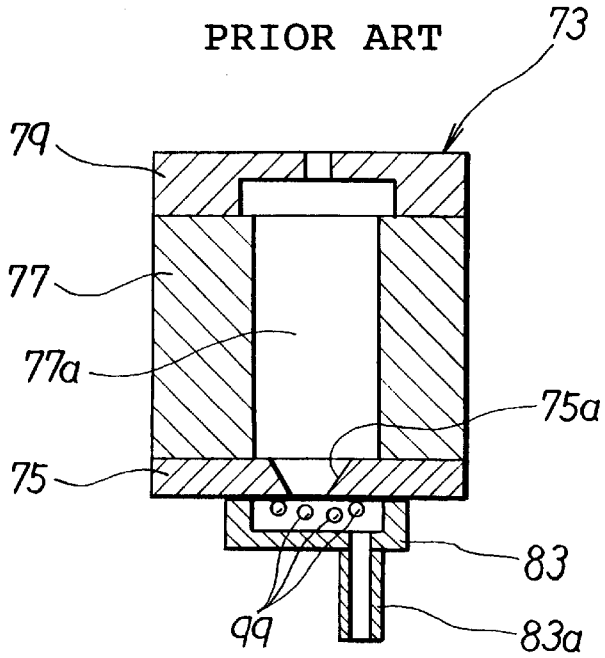
Fig. 5B PRIOR ART
Figure 5C:
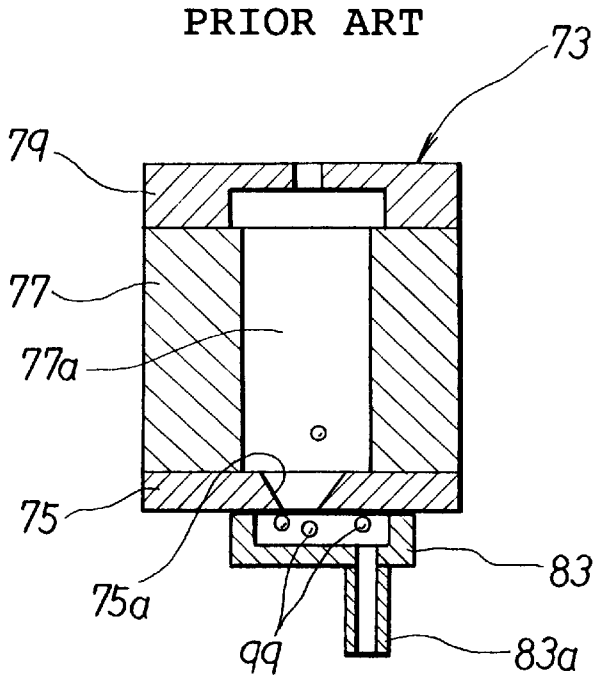
Fig. 5C PRIOR ART
Figure 5D:
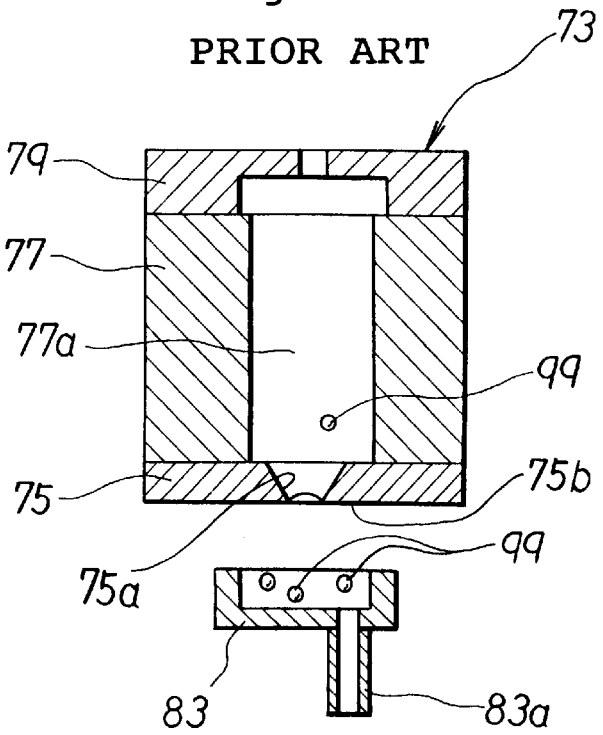
Fig. 5D PRIOR ART

Subsequently, the control 55 performs a suction and removal process as shown in FIGS. 4B–4D. First, as shown in FIG. 4B, the cap 33 is moved into compressive contact with the nozzle surface 5*b*. In the meantime, the open tank 21 is lifted until the ink surface 97*a* is positioned above the nozzle surface 5*b*. Thereafter, the suction pump 35 (not shown in FIGS. 4A–4D) is driven to suck and remove liquid ink 97, solidified ink, air bubbles 99, foreign substances, etc. from the ink chambers 7*a*. After the suction pump 35 is stopped with the ink surface 97*a* kept above the nozzle surface 5*b* as shown in FIG. 4C, the cap 33 is separated from the nozzle surface. Thereafter, as shown in FIG. 4D, the open tank 21 is lowered. This completes the suction and removal process.

In this example, although the cap 33 has been moved into compressive contact with the nozzle surface 5*b* before the open tank 21 is lifted to apply the positive pressure to the nozzle 5*a,* the open tank may be lifted to apply the positive pressure to the nozzle 5*a* before the cap is covered with the nozzle surface 5*b*. In this case, the positive pressure may be controlled so that the ink is not leaked out of the nozzle 5*a*.

The maintenance process also includes wiping the nozzle surface 5*b* with the wiper (not shown) after the suction and removal process. When the nozzle surface 5*b* is wiped, negative pressure is kept applied to the ink in the nozzle 5*a* to maintain an appropriate meniscus. It is therefore possible to clean the nozzle surface 5*b* well.

Thus, in the maintenance process, after the suction pump 35 is driven and until the cap 33 is separated from the nozzle surface 5*b* to decap the nozzle 5*a,* the ink surface 97*a* is kept above the nozzle surface. While the ink surface 97*a* is kept above, the head difference h2 (FIG. 4B) between it and the nozzle surface 5*b* applies positive pressure to the ink in the nozzle 5*a*. This keeps the pressure in the capped nozzle 5*a* higher than the pressure in the cap 33 after the suction pump 35 stops. Therefore, even after the pump 35 stops, the bubbles 99 etc. sucked into the cap 33 do not flow back into the ink jet head 3. It is consequently possible to remove the bubbles 99 etc. securely from the head 3, thereby preventing the head well from ejecting ink defectively.

The open tank 21 might be lifted just before the suction pump 35 stops. In this case, it is possible to remove air bubbles 99 etc. likewise, and reduce the amount of sucked ink so that ink is saved. If, as stated earlier, the open tank 21 is lifted before the suction pump 35 is driven, it is possible to reduce the load on this pump and remove the bubbles 99 rapidly.

The main tank 29 contains a large amount of ink 97. With ink supplied from this tank 29 to the open tank 21, the printer 1 can form an image continuously. Because the main tank 29 is closed, the ink in it alters little in quality. This enables the open tank 21 to be smaller relatively in volume, well preventing the ink in it from altering in quality. This also makes it possible to form a number of images continuously.

The head difference adjuster 23 is an example of the tank height adjuster. The electronic control circuit 55 and the driving of the adjuster 23 by it is an example of the pressure control unit. The invention is not limited to the foregoing embodiment, but various modifications may be made without departing from the spirit and scope of the invention.

The head difference adjuster 23 changes the level of the ink surface 97*a* to apply either positive or negative pressure to the nozzle 5*a*. Pressure might instead be applied to the nozzle 5*a* by either forced pressurization or forced pressure reduction with a pump or the like. However, the adjuster 23 makes very simple the system for changing the ink level, and can therefore make the apparatus simpler in structure. It might otherwise be possible to change the ink level by either inflating or deflating a balloon in the open tank 21. However, the adjuster 23 makes it easier to adjust the ink level, and simplifies the apparatus more in structure. Therefore, the foregoing embodiment can make the structure of the printer 1 and the control process simpler.

In the head different adjuster 23 of the above embodiment, the movable table 39 has been moved by the drive unit 43 and the vertical ball screw. However, it is possible to control the movable table 39 or the open tank 21 itself so as to move upward or downward without the drive unit 43 and the vertical ball screw in response to a movement of the carriage 11. For this purpose, a spring member which is connected to the movable table 39 and the sill 37 at the respective ends and a linking mechanism for linking the action of the movable table 39 to the movement of the carriage 11 may be provided. The movable table 39 may be urged downwardly by the spring member. The linking mechanism may lift the movable table 39 against the spring force of the spring member when the carriage comes into the maintenance area for maintenance operation from the printing area. The linking mechanism may comprise a swing or rotatable arm which can swing or rotate about an axis. When the carriage 11 moves into the maintenance area, a portion of the carriage 11 can contacts with one end of the arm to swing or rotate the arm such that the other end of the arm can lift the movable table 39 against the downwardly urging force of the spring member. Once the carriage 11 returns to the printing area, the arm swings or rotates back to the original state and thereby the force for lifting the movable table 39 is released. As a result, the movable table 39 returns to the original height position by means of the spring member. In the above modification, the spring member may be connected directly to the open tank 21 and the movable stage may be a part of the open tank 21.

The ink jet head 3 is connected through the tube 19 to the open tank 21. Therefore, the invention can also be applied suitably to a printer in which the ink jet head is not moved by a carriage, but mounted in a fixed position, and only a recording sheet can move.

What is claimed is:

1. An ink jet recorder comprising:

an ink jet head having a nozzle for ejecting ink and ink passages formed in the head, the passages communicating with the nozzle;

a suction cap relatively movable between a first position in airtight contact with the nozzle and a second position separated from the nozzle;

a suction pump that sucks ink from the nozzle through the suction cap to purge the nozzle;

an ink supply for supplying the head with ink; and a pressure control unit provided between the ink supply and the ink jet head for controlling the pressure applied to the ink in the nozzle, wherein the nozzle is purged by the suction pump when the suction cap is in the first position and the pressure control unit applies positive pressure to the ink in the nozzle before the suction cap is moved to the second position separated from the ink jet head.

2. The ink jet recorder defined in claim 1, wherein the pressure control unit applies negative pressure to the ink in the nozzle when the suction cap is not in the second position.

3. The ink jet recorder defined in claim 1, wherein the pressure control unit includes:

an ink tank in liquid communication with the ink passages in the ink jet head; and a tank height adjuster for adjusting the height of the tank relative to a front end of the nozzle.

4. The ink jet recorder defined in claim 3, wherein the tank height adjuster makes an ink surface in the ink tank higher than an ink surface in the nozzle to apply the positive pressure to the ink in the nozzle.

5. The ink jet recorder defined in claim 3, wherein the tank height adjuster makes an ink surface in the ink tank lower than an ink surface formed in the nozzle to apply negative pressure to the ink in the nozzle so that an ink menisci can be maintained in the nozzle when the suction cap is in the second position.

6. The ink jet recorder defined in claim 5, further comprising a detector that detects the ink level in the ink tank, the controller being based on the result of the detection by the detector to control the tank height adjuster in such a manner that an ink surface in the ink tank is positioned at a predetermined level relative to the fort end of the nozzle.

7. The ink jet recorder defined in claim 3, and further comprising a controller for controlling the driving of the tank height adjuster and the suction pump.

8. The ink jet recorder defined in claim 7, wherein the controller controls the operation of the tank height adjuster in such a manner that, while the nozzle is purged by the suction pump through the suction cap, positive pressure is applied to the ink in the nozzle before the purging is complete and the suction cap is moved to the second position.

9. The ink jet recorder defined in claim 7, wherein the controller controls the operation of the tank height adjuster in such a manner that, while the nozzle is purged by the suction pump through the suction cap, positive pressure is applied to the ink in the nozzle after the suction pump starts sucking and until the suction cap is moved to the second position.

10. The ink jet recorder defined in claim 7, wherein the controller controls the operation of the tank height adjuster in such a manner that negative pressure is applied to the ink in the nozzle when the suction cap is in the second position.

11. The ink jet recorder defined in claim 3, further comprising a detector that detects the ink level in the ink tank.

12. The ink jet recorder defined in claim 3, wherein the height adjuster includes a movable stage for placing the ink tank thereon to move the ink tank upwardly and downwardly and a driving unit for the movable stage.

13. The ink jet recorder defined in claim 3, further comprising a carriage for placing thereon and moving the ink jet head, wherein the tank height adjuster comprises a spring member for urging the ink tank downwardly and a linking mechanism for linking a movement of the ink tank to a movement of the carriage.

14. The ink jet recorder defined in claim 1, wherein the ink supply is an ink cartridge.

15. The ink jet recorder defined in claim 14, wherein the ink cartridge contains ink and is sealed.

16. The ink jet recorder defined in claim 14, wherein the ink cartridge is larger in volume than the ink tank.

17. The ink jet recorder defined in claim 1, wherein side walls of the ink passages are made of piezoelectrical material.

18. The ink jet recorder defined in claim 1, wherein the pressure control unit applies the positive pressure just prior to completion of purging and before the suction cap is moved to the second position.

19. The ink jet recorder defined in claim 1, wherein the pressure control unit maintains the positive pressure after the suction pump is turned off at a completion of purging until the suction cap is moved to the second position.

* * * * *